US005749158A

United States Patent [19]

Muller et al.

[11] Patent Number: 5,749,158

[45] Date of Patent: May 12, 1998

[54] APPARATUS FOR THE APPLICATION OF STEAM ONTO A PAPER WEB

[75] Inventors: Dieter Muller, Sontheim; Markus Oechsle, Bartholoma, both of Germany

[73] Assignee: Voith Sulzer Papiermaschinen Gmbh, Germany

[21] Appl. No.: 718,145

[22] Filed: Sep. 18, 1996

Related U.S. Application Data

[63] Continuation-in-part of PCT/DE95/00060, Jan. 19, 1995.

[51] Int. Cl.[6] ..... D21F 5/00

[52] U.S. Cl. ..... 34/119; 34/120; 34/122

[58] Field of Search ..... 34/117, 119, 120, 34/122; 162/206, 207, 359.1, 360.3

[56] References Cited

U.S. PATENT DOCUMENTS

| | | | |
|---|---|---|---|
| 4,351,700 | 9/1982 | Dove | 162/252 |
| 4,398,355 | 8/1983 | Dove | 34/54 |
| 4,765,067 | 8/1988 | Taylor | 34/465 |
| 4,836,894 | 6/1989 | Chance et al. | 162/253 |
| 5,120,400 | 6/1992 | Laapotti | 162/206 |
| 5,282,323 | 2/1994 | Winheim | 34/155 |
| 5,569,359 | 10/1996 | Joiner | 162/206 |

FOREIGN PATENT DOCUMENTS

| | | |
|---|---|---|
| 1 076 861 | 5/1980 | Canada . |
| 2751245 | 6/1979 | Germany . |
| 4125062 | 2/1993 | Germany . |

*Primary Examiner*—Henry A. Bennett
*Assistant Examiner*—Steve Gravini
*Attorney, Agent, or Firm*—Ostrolenk, Faber, Gerb & Soffen, LLP

[57] ABSTRACT

An apparatus for the application of steam onto a paper web has a steam blower box with numerous zone chambers arranged side by side over the web width. The steam blower box is displaceable so that the spacing between it and the web path is adjustable. A steam supply line extends from each zone chamber in the longitudinal direction through the interior of the steam blower box, and from there outward to a support plate. There the clearance between adjacent steam lines is substantially greater than in the interior of the steam blower box. A steam control valve, that is connected via a flexible line to the support plate, is provided for each zone chamber laterally outside the paper-making machine.

13 Claims, 7 Drawing Sheets

APPARATUS FOR THE APPLICATION OF STEAM ONTO A PAPER WEB

CROSS-REFERENCE TO RELATED APPLICATIONS

This is a continuation-in-part of International Application PCT/DE95/00060, with an international filing date of Jan. 19, 1995.

BACKGROUND OF THE INVENTION

The present invention relates to an apparatus for the application of steam onto a paper web, for example onto a paper web that is passing through the press section of a paper-manufacturing machine. A steam blower box is a principal part of such an apparatus. Reference is made to German published application DE 41 25 062 A1.

A steam blower box of this kind is utilized primarily in paper manufacturing. Its purpose is, with the aid of the steam applied onto the material web, to raise the temperature of the material web in order to increase the dewatering performance of the press section. The steam blower box offers the possibility of influencing the transverse moisture profile of the material web by sectionally varying steam application.

In the known design, steam emerging from the sectional chambers (or "zone chambers") is controlled by valves that are arranged inside the steam blower box. Each correction zone is fitted with a separate, generally pneumatically controlled valve.

Failure of a control valve means first of all that the corresponding zone can no longer be corrected, which leads to an impairment of paper quality. Replacement of a defective valve requires an expensive production shutdown. A long time period, during which reject paper is occasionally produced (removal, installation, and warmup time), is sometimes required before a stable operating state is then achieved again.

SUMMARY OF THE INVENTION

It is a first object of the invention to provide an improved apparatus of the type described above that allows to select as small a width as possible for the zone chambers, and to make the number of zone chambers correspondingly large (for a given steam blower box length).

It is a second object of the invention to provide an improved steam blower box that is easy to repair or replace with no need to shut down the machine temporarily for this purpose.

It is a third object of the invention to provide an improved steam blower box that allows for adjustment of the spacing between the steam blower box and the web passing by (which at that point is usually supported by a roll). Under normal operating conditions the spacing should be relatively small, but relatively large during startup or for maintenance purposes.

These and other objects are achieved by the invention.

While in the prior art the predefined size of the control valves determines the smallest possible width of the zone chambers, according to the invention the zone chambers can have dimensions as small as desired, since the control valves are always arranged outside the steam blower box, specifically alongside the machine.

This also provides the additional advantage that the control valves are accessible even while the machine is operating, so that if necessary one or the other control valve can be repaired or replaced without requiring a costly machine shutdown for the purpose.

With the design according to the invention, each zone chamber must be connected to one of the control valves by means of its own ("sectional") steam line. An additional complicating factor lies in the fact that because of the displaceability of the steam blower box, a portion of each sectional steam line must be made movable. Each sectional steam line thus comprises a part mounted on the steam blower box (with an inflow end located outside the steam blower box), and a movable part that is connected on the one hand (directly or indirectly) to the relevant control valve and on the other hand can be coupled to the said inflow end by means of a line connection. In this context, an essential part of the idea of the invention consists in the fact that the clearance between adjacent inflow ends (of the line parts mounted on the steam blower box) is substantially greater than the clearance provided inside the steam blower box between adjacent sectional steam lines. In other words, the parts of the sectional steam line mounted on the steam blower box fan out, opposite to the flow direction, outside the steam blower box. Only in this manner is it possible, when the cross-sectional dimensions of the steam blower box are relatively small, to provide an unusually large number of sectional steam lines (and thus a large number of relatively narrow zone chambers), and still have enough room available at the inflow ends for the line connections of the movable line parts that are to be coupled.

According to a preferred embodiment of the invention, the following provisions are made:

The steam is fed from a main steam line to a steam distributor that is arranged outside the paper-making machine, preferably alongside the paper-making machine, for example on the drive side or, for example, in the underfloor, but in any case at a point easily accessible during operation of the machine. The individual control elements (control valves) are arranged on this steam distributor. Each individual zone chamber of the steam blower box is connected to the corresponding control valve via a separate sectional steam line. The parts of the sectional steam lines mounted on the steam blower box end (opposite to the flow direction) outside the steam blower box on a plate, for example support plate, that is rigidly joined to the steam blower box. Flexible lines between the support plate and the control valves serve to accommodate swiveling movements and to compensate for any thermal elongation of the steam blower box. The valve drives are controlled by electric motors.

SHORT DESCRIPTION OF THE DRAWINGS

The invention will be described below with reference to a preferred exemplified embodiment, in conjunction with the following drawings, in which FIG. 1 is a general view;

Figure 2:
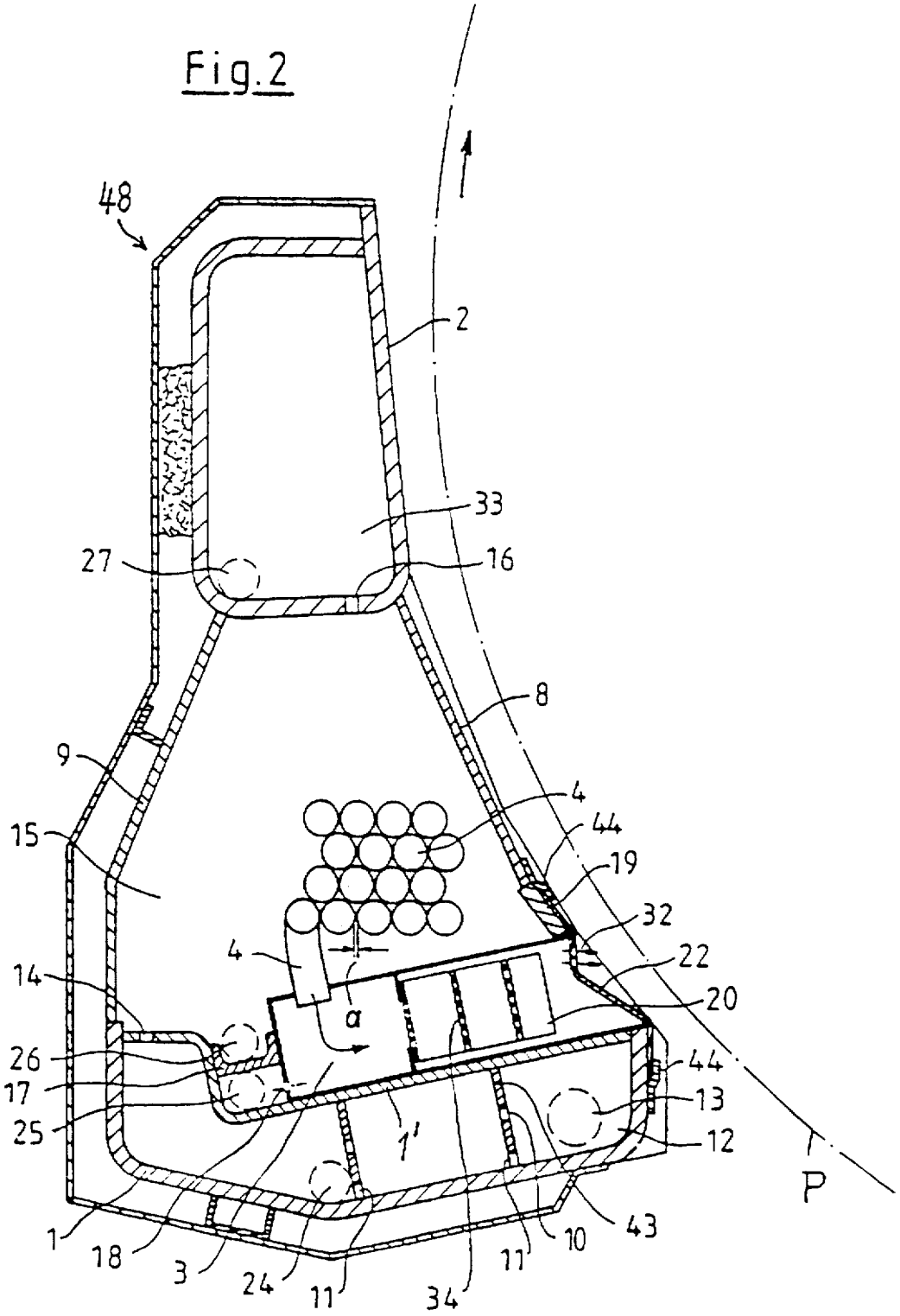
FIG. 2 shows a cross section through a steam blower box.
Figure 3:
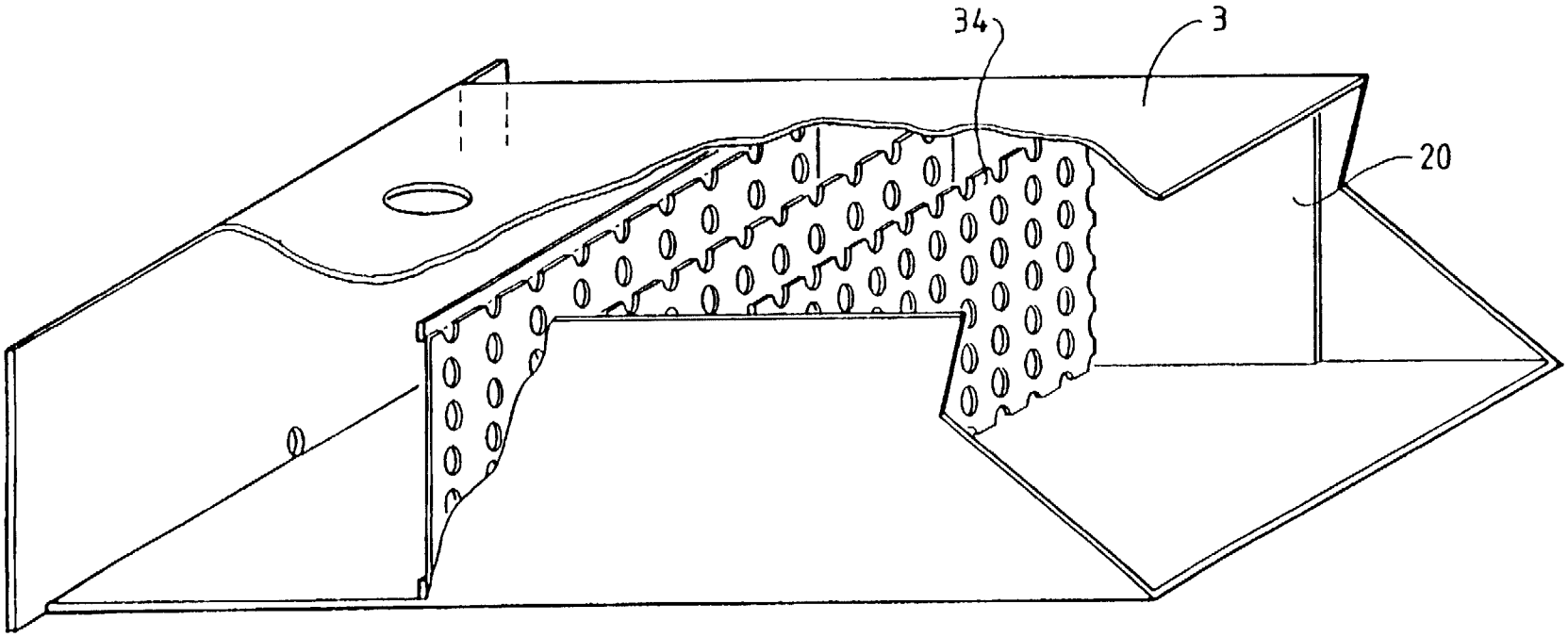
FIG. 3 shows a zone chamber with perforated panel insert.
Figure 4:
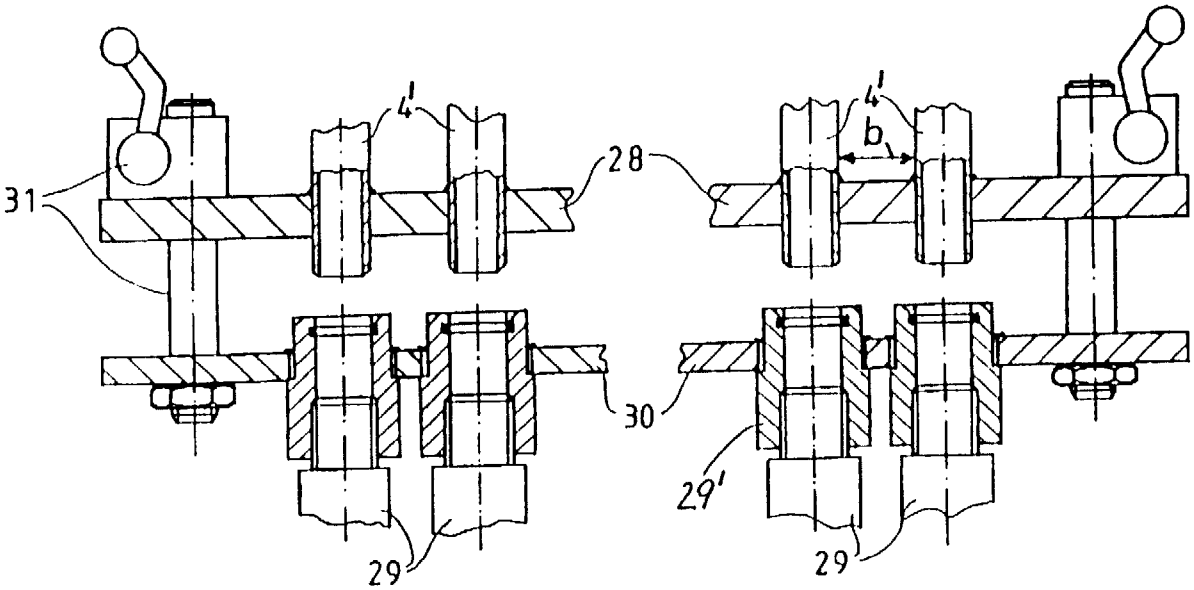
Figure 5:
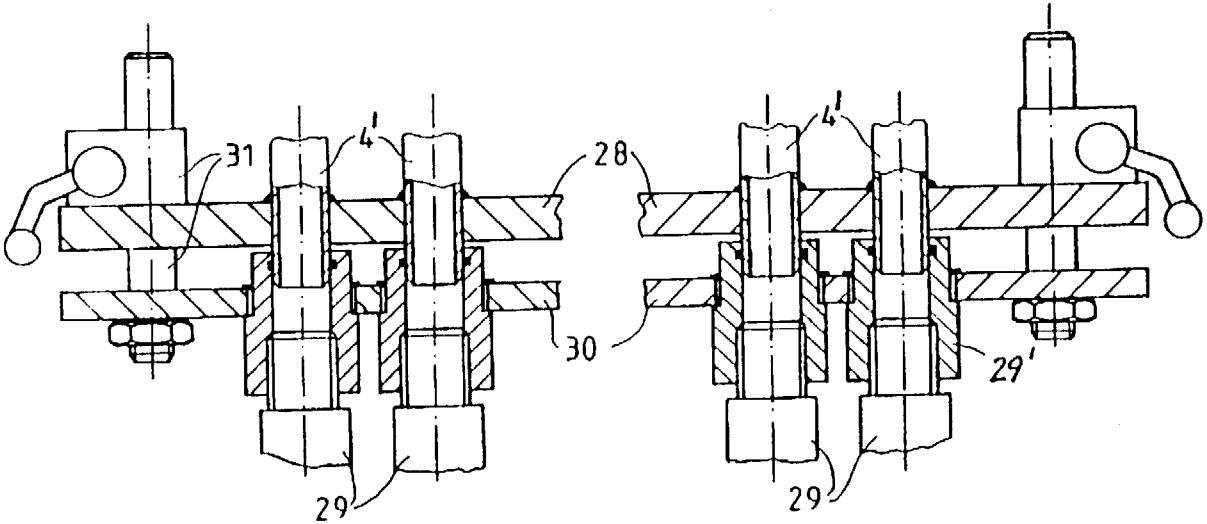
Figure 6:
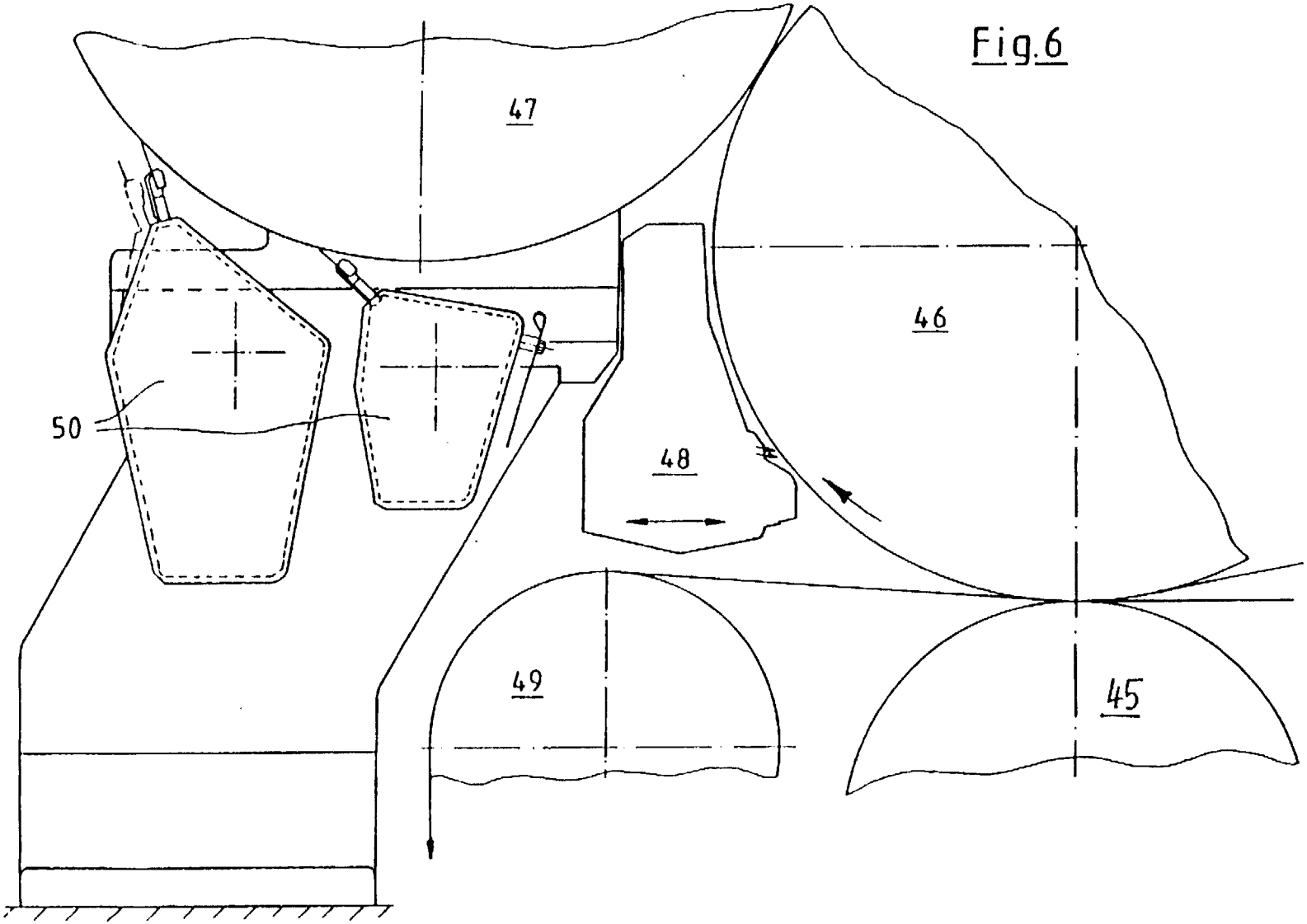
Figure 7:
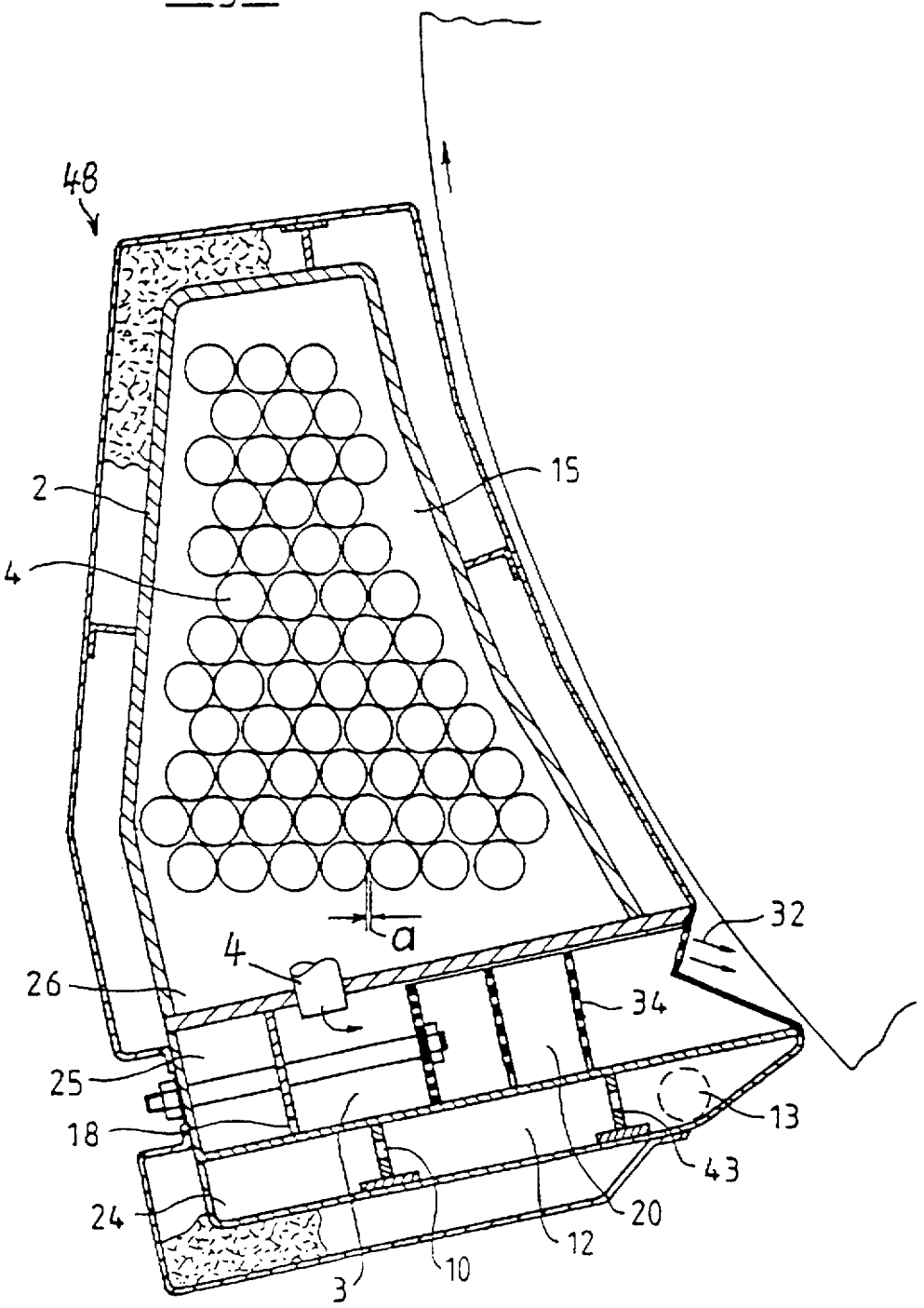

FIGS. 4/5 shows the connection between the flexible lines and the steam blower box lines: FIG. 4, detached; FIG. 5, attached;

FIG. 6 shows an example of installation in a press section;

FIGS. 7/8 shows an exemplified embodiment diverging from FIGS. 2 and 3.

DETAILED DESCRIPTION OF THE PREFERRED EMBODIMENTS

Figure 1:
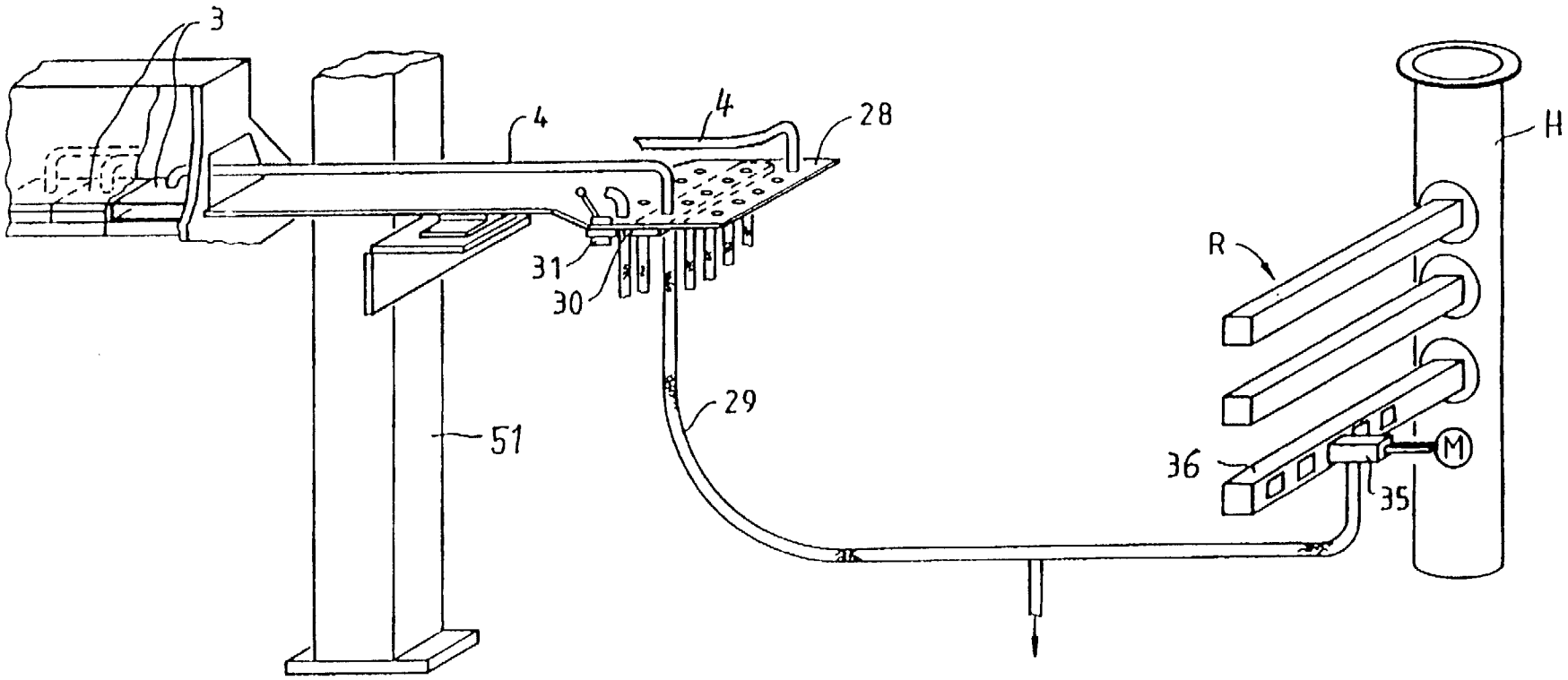

The steam blower box 48 consists of a self-supporting stainless steel structure; it extends, transverse to the web travel direction through the paper-making machine from guide side FS to drive side TS (FIG. 8), along the outer surface of a roll which guides paper web P. Only the drive-side end of the steam blower box is shown in FIG. 1. Webs 43, which have orifices 10 and 11, are welding into lower support frames 1, 1'. Lower support frames 1, 1' and an upper support frame 2 are joined to one another via side walls 8 and 9. Optimum transverse stability is achieved with this construction. Support frames 1, 1', and 2 and side walls 8 and 9 delimit a central chamber 15. Through this extends a tube bundle consisting of a plurality of steam lines 4, each of which opens into a zone chamber 3 so as thereby to apply "steam I" onto paper web P as it passes by.

Figure 8:
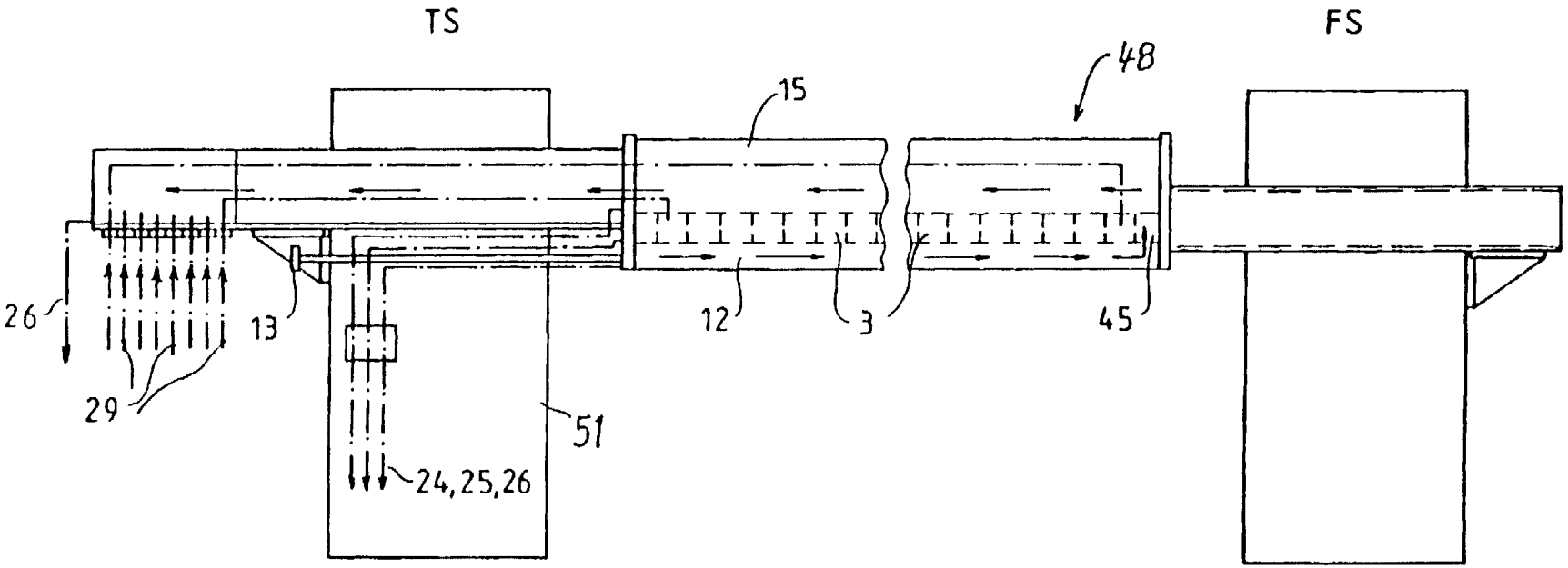

A steam conduit 13 opens into lower chamber 12. According to FIG. 1, the preheating steam ("steam II") flowing in here passes through orifices 10 and 14 into chamber 15 which encloses tube bundle 4. This steam II passes lastly through orifices 16 into chamber 33 of support frame 2. In a divergent exemplified embodiment, inflowing steam II is guided first through chamber 12 from drive side to guide side, and passes through orifices in connecting zone 45 into chamber 15 (FIGS. 7 and 8). This steam II, whose temperature is greater than steam I inside sectional steam lines 4, ensures that even when the valves are closed, no cooling of the sectional steam lines 4 or the individual zone chambers 3 occurs. Among the results of this is that little or no condensation forms in the steam lines and in the zone chambers. Moreover a strict separation between steam I and steam II is ensured.

The individual zone chambers 3 are arranged on lower support frames 1, 1'. They are fastened by means of side panels 19 and 17. A separate steam line 4 opens into each zone chamber. Each zone chamber contains a perforated panel insert 20 with perforated panels 34 whose open cross-sectional area increases toward the steam exit. The effect of these perforated panels 34 is to distribute steam I uniformly over the zone width within the individual zones. The individual perforated panel inserts 20 can be pulled out for maintenance purposes (FIG. 3).

The individual zone chambers 3 are delimited by one (according to FIG. 1) common steam exit panel 22. This is bolted to panel parts 19 and 1, or fastened by means of guide bars 44, so it can easily be removed for cleaning purposes. It has multiple rows of blower openings 32, arranged behind one another in the longitudinal direction. The steam exit direction can be perpendicular to the paper travel direction or, according to FIG. 2, inclined so that steam I flows against the web as it arrives. Runoff openings 11, 18, with associated dewatering troughs 24, 25, 26, 27, are provided wherever steam condensation might occur.

According to FIG. 1 the drive-side end of steam blower box 48 rests, by means of a support plate 28 that can be an extension of, for example, lower support frame 1, 1', displaceably on a stand 51. Steam lines 4 are extended outward, opposite to the steam flow direction, beyond the drive-side end of the steam blower box; their inflow ends are, for example, immovably joined to support plate 28. A control element, designated overall as R, is arranged laterally outside the paper-making machine, and comprises for each zone chamber 3 a control valve 35 driven by a stepping motor M. The connection from control valves 35 to support plate 28 is provided by, lines 29 that are configured at least partly as flexible lines. Outflow ends 29' of a number of the flexible lines are fastened to a "supply plate" 30. This supply plate is joined by means of quick clamping elements 31 to support plate 28. By means of these quick clamping elements, rapid decoupling is possible in the event of removal of the steam blower box (see FIGS. 4 and 5). Control valves 35 are designed so that several of them can be combined next to one another on one steam distribution conduit 36. Steam is supplied to each steam distribution conduit 36 from a main steam line H.

The advantages of the construction of control element R as just described are:

1. The location outside the steam blower box allows a very large number of zone chambers 3, and convenient maintenance of valves 35 while the machine is running.
2. No restriction on steam temperature is necessary, since the control valves have no parts subject to wear, such as diaphragms (no steam cooling).
3. Extremely precise metering of steam volumes is possible due to the stepping-motor drive system.
4. Easy and cost-effective changeover from manual to automatic control is possible.
5. No compressed-air supply is required (eliminates the I/P converter).
6. The valve position can be read directly.

A known method can be used to ensure that the steam volume emerging from the valve is almost independent of the resistance values downstream, i.e. this guarantees that despite differences in the steam line lengths for the individual zones, approximately the same steam volume emerges from each zone for the same valve setting.

It is evident from the cross sections in FIGS. 2 and 7 that inside steam blower box 48 and 48', respectively, sectional steam lines 4 are located above and next to one another so they almost touch (clearance a). The same steam lines fan out, however, outside the steam blower box, so that relatively large clearances b exist at their inflow ends 4'; b can be (as an example) 10 to 50 times greater than a (FIG. 4). The number of zone chambers 3 can thus be made very large (and their width B very small); at the same time all couplings 29' which connect flexible lines 29 to inflow ends 4' can be arranged in one and the same plane on support plate 28.

In extreme cases, the width of the individual zone chambers can be reduced to a dimension that is only slightly greater than the outside diameter of the individual steam line 4.

FIG. 6 schematically shows a press section in which a prepressing nip, through which the paper web being dewatered passes together with two felts, is constituted between two press rolls 45 and 46. After the pre-pressing nip the lower felt passes to a felt guide roll 49, while the paper web, together with the upper felt on press roll 46 (usually a suction press roll), passes upward into a press nip formed between rolls 46 and 47. Press roll 47 is feltless, i.e. it comes into direct contact with the paper web. One or two scrapers 50 are therefore provided for continuous cleaning of this roll. Steam blower box 48, already described above in detail, is arranged in the very tight space between rolls 49, 46, and 47 on the one hand, and scrapers 50 on the other hand. It is shown in the normal operating position, but it is horizontally displaceable so it can temporarily be brought into a position away from roll 46.

We claim:

1. An apparatus for the application of steam onto a material web passing along a web path through a paper-manufacturing machine, comprising:

an elongated steam blower box extending transversely to the web path over the entire width of the web;

a plurality of zone chambers arranged side by side over the width of the web;

a plurality of sectional steam lines for connecting each zone chamber to a steam source, each sectional steam line comprising an outflow end within the steam blower box, an inflow end and a control valve, both located outside the steam blower box;

wherein each of said control valves is arranged laterally at a distance from the steam blower box and is connected to the inflow end of said sectional steam line via a movable part of said sectional steam line.

2. The apparatus of claim 1, wherein adjacent inflow ends of sectional steam lines outside said steam blower box are arranged at a clearance between each other which is considerably larger than the clearance between adjacent sectional steam lines within said steam blower box.

3. The apparatus of claim 1, wherein there is an operational spacing between the steam blower box and the web path wherein said steam blower box is mounted displaceably so as to allow for adjustment of the operational spacing between the steam blower box and the web path.

4. The apparatus of claim 1, comprising means for feeding steam into said steam blower box for preheating said steam blower box independently from the steam fed into said sectional steam lines.

5. The apparatus of claim 1, comprising at least one support plate arranged outside one end of said steam blower box, each of said inflow ends of said sectional steam lines being fixed to said support plate.

6. The apparatus of claim 5, wherein said movable parts of said sectional steam lines each comprise a flexible part connected to the control valve, said flexible parts fixed in groups to a supply plate which is arranged displaceably with respect to said support plate allowing coupling and decoupling of said flexible parts to said inflow ends by moving said supply plate with respect to said support plate.

7. The apparatus of claim 1, further comprising a plurality of stepping motors, each said stepping motor adapted to control a respective control valve.

8. The apparatus of claim 1, wherein each said zone chamber has a width that is approximately equal to the diameter of the respective sectional steam line ending therein.

9. The apparatus of claim 1, wherein said steam blower box comprises a cavity provided in an upper region thereof allowing insertion of a support in the longitudinal direction of the steam blower box.

10. A press section for a paper-manufacturing machine comprising at least three press rolls, wherein a paper web passes along a web path together with a felt through a nip formed between a first one of said press rolls and a second one of said press rolls and enters into a press nip formed between the second press roll and a third one of said press rolls which is configured as a feltless press roll, said press section further comprising an elongated steam blower box extending transversely to the web path over the entire width of the web and adjacent said second press roll for applying steam to the second press roll, said steam blower box being arranged displaceably with respect to said second press roll so as to allow for adjustment of the spacing between both press rolls;

a plurality of zone chambers arranged side by side over width of the web;

a plurality of sectional steam lines for connecting each zone chamber to a steam source, each sectional steam line comprising an outflow end located inside the steam blower box and an inflow end and a control valve, both located outside the steam blower box.

11. The press section of claim 10, further comprising a scraper which is arranged on a peripheral portion of said third press roll which is not contacted by the web.

12. The press section of claim 11, further comprising a second scraper arranged behind the other scraper on said peripheral portion of said third press roll.

13. The press section of claim 10, wherein the nip between said first and said second press roll is configured as a prepressing nip through which a second felt is passed which is guided over a guide roll arranged adjacent said first press roll.

* * * * *